US006105881A

United States Patent [19]

Kitajima

[11] Patent Number: 6,105,881

[45] Date of Patent: Aug. 22, 2000

[54] AIR BRUSH

[75] Inventor: Katsuaki Kitajima, Saku, Japan

[73] Assignee: B. B. Rich Co., Ltd., Japan

[21] Appl. No.: 08/997,892

[22] Filed: Dec. 24, 1997

[30] Foreign Application Priority Data

Oct. 14, 1997 [JP] Japan ..... 9-280312

[51] Int. Cl.[7] ..... B05B 7/30; F23D 14/60

[52] U.S. Cl. ..... 239/353; 239/371; 239/528; 239/DIG. 19

[58] Field of Search ..... 239/345, 353, 239/371, 415, 416.4, 416.5, 417.3, 528, 530, 532, DIG. 19

[56] References Cited

U.S. PATENT DOCUMENTS

| | | | |
|---|---|---|---|
| 555,669 | 3/1896 | Wold | 239/345 |
| 1,703,359 | 2/1929 | Paasche | 239/345 |
| 4,161,289 | 7/1979 | Rebold | 239/346 |
| 4,434,939 | 3/1984 | Stankowitz | 239/345 |

FOREIGN PATENT DOCUMENTS

| | | | |
|---|---|---|---|
| 281759 | 6/1913 | Germany | 239/345 |

*Primary Examiner*—Andres Kashnikow
*Assistant Examiner*—Jorge Bocanegra
*Attorney, Agent, or Firm*—Bacon & Thomas

[57] ABSTRACT

An air brush having an easily installed nozzle member and a cost-effective extremity end member. The nozzle member is held between a nozzle cap and an outlet end of the main body of the air brush. The nozzle member is made such that it's front and rear parts are substantially conical in shape. An insertion hole extends through and is formed in the nozzle member. The rear part of the nozzle member is inserted into the tapered hole at the outlet end of the main body of the air brush. The front part of the member is internally fitted into the nozzle cap and secured. The nozzle member is made such that it's outlet end is composed of the extremity end member. The extremity end member is made of SPM material which is harder, stronger and more durable than the other portions of the device, and the extremity end member includes a very strong nozzle section in order to prevent the occurrence of corrosion or cracks.

3 Claims, 5 Drawing Sheets

AIR BRUSH

BACKGROUND OF THE INVENTION

1. Field of the Invention

This invention relates to an improvement of an air brush.

FIG. 5 shows the prior art air brush.

2. Description of the Related Art

This air brush is provided with a main body 101 of air brush which is formed into a substantially pencil shape. The extremity end, nozzle fixing section 121 which is incorporated with the aforesaid main body 101 of the air brush is provided with a nozzle 102, wherein a needle 104 for opening or closing the nozzle 102 is slidably inserted along an axis of the main body 101 of the air brush.

The aforesaid nozzle 102 is constructed such that a screw type nozzle member 120 formed into a substantially conical shape is threadably installed at an extremity end port of the nozzle fixing section 121 projected and formed at an axial section of the extremity end of the main body 101 of the air brush and the extremity end of the aforesaid needle 104 is passed through the axial section of the nozzle member 120 in such a way that it may be pulled off from it.

An intermediate section of the main body 101 of the aforesaid air brush is provided with an air supplying port 106 to which an air supplying hose 111 or an air bomb or the like act as a supply source for supplying compressed air, the compressed air supplied from the air supplying port 106 is passed through an air valve 107 and an aeration passage 110 formed within the main body 101 of the air brush and supplied to the aforesaid nozzle 102.

To the air valve 107 arranged in the aforesaid air supplying port 106 and the needle 104 is connected an operating lever 105 arranged at an upper part of the main body 101 of the air brush, the aforesaid operating lever 105 is pushed down to cause the aforesaid air valve 107 to be opened and at the same time the operating lever 105 is pulled toward a rearward direction to cause the needle 104 to be retracted and the nozzle 102 to be opened.

Thus, the aforesaid air brush is operated such that supplying of the compressed air is started against the nozzle 102 under an operation of the aforesaid operating lever 105. A proper amount of painting material is supplied from a paint container 103 installed just after the nozzle 102 and with injection of the compressed air and fine atomization of the paint particles are carried out at the nozzle 102.

In turn, as the prior art air brush, there is provided an air brush having a nozzle 102 formed by the aforesaid screw type nozzle member 120 and another air brush having a nozzle formed by a tapered type nozzle member (FIG. 6).

The air brush shown in FIG. 6 is provided with a tapered type nozzle member 130 having its front end and rear end formed into fine conical shape, wherein the rear end part of the tapered type nozzle member 130 is fitted to and inserted into the tapered hole 131 formed at a circumference of the axial section of the extremity end of the main body 101 of the air brush, thereby the tapered type nozzle member 130 is held in coaxial with the main body 101 of the air brush.

In addition, the aforesaid tapered type nozzle member 130 is constructed such that the extremity end having a fine end conical shape is inserted into an inner circumference of a nozzle cap 132 threadably fitted and connected to the extremity end of the main body 101 of the air brush, thereby it is held between the extremity end of the main body 101 of the air brush and the nozzle cap 132, the extremity end of the needle 104 is passed through the axial center of the aforesaid tapered type nozzle member 130 so as to constitute a nozzle 102' acting in the same manner as that of the nozzle 102 of the air brush shown in FIG. 5.

As described above, in the prior art air brush, there is provided an air brush in which the nozzle 102 is constituted by the screw type nozzle member 120 and another air brush in which the nozzle 102' is constituted by the tapered type nozzle member 130, wherein although their structures are different from each other, the extremity end of the needle 104 is passed through it in such a way that it may be freely pulled and then the needle is operated as a valve for discharging the paint.

The screw type nozzle member 120 installed in the airbrush shown in FIG. 5 is made of material such as SPM (sun platinum metal) having a hard and high strength and this has a substantial reliability in view of strength and accuracy for machining a predetermined shape.

However, since the screw type nozzle member 120 is a quite small component, operations for threadably fitting the nozzle member 120 to the nozzle fixing section 121 at the extremity end of the main body 101 of the air brush and fastening or loosening it with an exclusive wrench during maintenance work for the nozzle 102 become fine operations and there is a certain problem in handling of the air brush. In view of this fact, the nozzle member 120 is unsuitable for quick attachment or removal due to its small size. In the case of the tapered type nozzle member 130, it has some advantages that due to its larger size, its handling is easily carried out and a fixing or removing of it to or from the extremity end of the main body 101 of the air brush can be carried out with one finger touch without using any tool.

In addition, in the case of the tapered type nozzle member 130, it is required to have a certain size in view of some reasons in manufacturing or fixing accuracy as compared with that of the aforesaid screw type nozzle member 120. Accordingly, if material quality (SPM or the like) which is expensive and hardly machined as found in the screw type nozzle member 120 is used, a substantial increased cost is not avoidable, resulting in that material quality such as nickel silver or the like which is relatively less-expensive and has a certain strength is normally applied for its manufacturing.

As a result, the aforesaid tapered type nozzle member 130 is thin in its wall thickness, a strength of an edge part of opening of the extremity end receiving a pressing force from the extremity end of the needle 104 is reduced and it becomes hard to assure a strength of the aforesaid screw type nozzle member 120 using SPM. Thus, in the case that the nozzle member is used within a normal range, no problems occur, although when a user performs an excessive handling of the brush such as a case in which the needle 104 is excessively pushed into the nozzle member, there is a possibility that a cut or a crack may occur at the port edge of the extremity end section of the nozzle member 130 having a thin-wall therein (FIG. 7).

SUMMARY OF THE INVENTION

An object of the present invention relates to an air brush described above and is to provide an air brush in which it is easily installed at the main body of the air brush and there is provided a nozzle member capable of sufficiently assuring a strength of the port edge part of the extremity end in a low cost.

In order to solve the aforesaid problems, the air brush of the present invention is made such that a nozzle is constructed by a needle passed through an axial core of a main body of the air brush, a nozzle cap removably connected to the extremity end of the main body of the aforesaid air brush and a nozzle member having the extremity end of the aforesaid needle inserted therein while being held between the aforesaid nozzle cap and the extremity end of the main body of the air brush, the aforesaid nozzle member comprising a main body of the nozzle member and an extremity end member of the nozzle member to be fitted into the extremity end (tip) of the main body of the nozzle member is made such that each of circumferential surfaces of its front part and rear part is formed into a substantial fine conical shape, a needle insertion hole is passed and formed at the axial core section, the rear section of the aforesaid nozzle member is fitted and inserted into a tapered hole formed around the axial core section at the extremity end of the main body of the air brush while their shapes being coincided to each other, the front section of the nozzle member is internally fitted to the inner circumferential part of the aforesaid nozzle cap and supported there, the main body of the aforesaid nozzle member is formed by using a general metal material while the extremity end of the nozzle member is constructed with SPM.

With the aforesaid means being applied, the nozzle member having the extremity end of the needle passed and inserted therein is made such that each of the front part and the rear part is formed into a fine conical shape at its extremity end, the insertion hole having the needle passed therein is passed and formed at the axial core section. That is, the aforesaid nozzle member is formed into the same outer shape as that of the prior art tapered type nozzle member.

In addition, the extremity end of the aforesaid nozzle member is separately formed by the more hard extremity end member of the nozzle member than that of other portions and a strength of the port edge of the extremity end of the nozzle member is assured with the extremity end member of the nozzle member.

The aforesaid nozzle member is made such that its rear part is fitted and inserted into the tapered hole formed at a circumference of the axial core part at the extremity end of the main body of the air brush while their shapes being coincided to each other, and the front part is internally fitted to the inner circumferential part of the nozzle cap, thereby it is held between the extremity end of the main body of the air brush and the air cap connected to it while it is coincided with the axial core of the main body of the air brush and then the extremity end of the needle is inserted into the insertion hole of the axial core part.

That is, the port edge of the extremity end of the aforesaid nozzle is constituted by a more hard extremity end member of nozzle member than that of other portions and the extremity end of the needle inserted into the insertion hole of the nozzle member is contacted with the extremity end of the aforesaid nozzle member under a closed state of the nozzle.

In addition, the extremity end of the aforesaid nozzle member may be removably engaged with the extremity end of the nozzle member.

In this case, the extremity end member of the nozzle member can be installed at the extremity end of the nozzle member easily and accurately and fixed there. Additionally, with this structure being employed, it becomes possible to use the prior art screw type nozzle member as the extremity end member of the nozzle as it is.

DETAILED DESCRIPTION OF THE PREFERRED EMBODIMENTS

Figure 1:
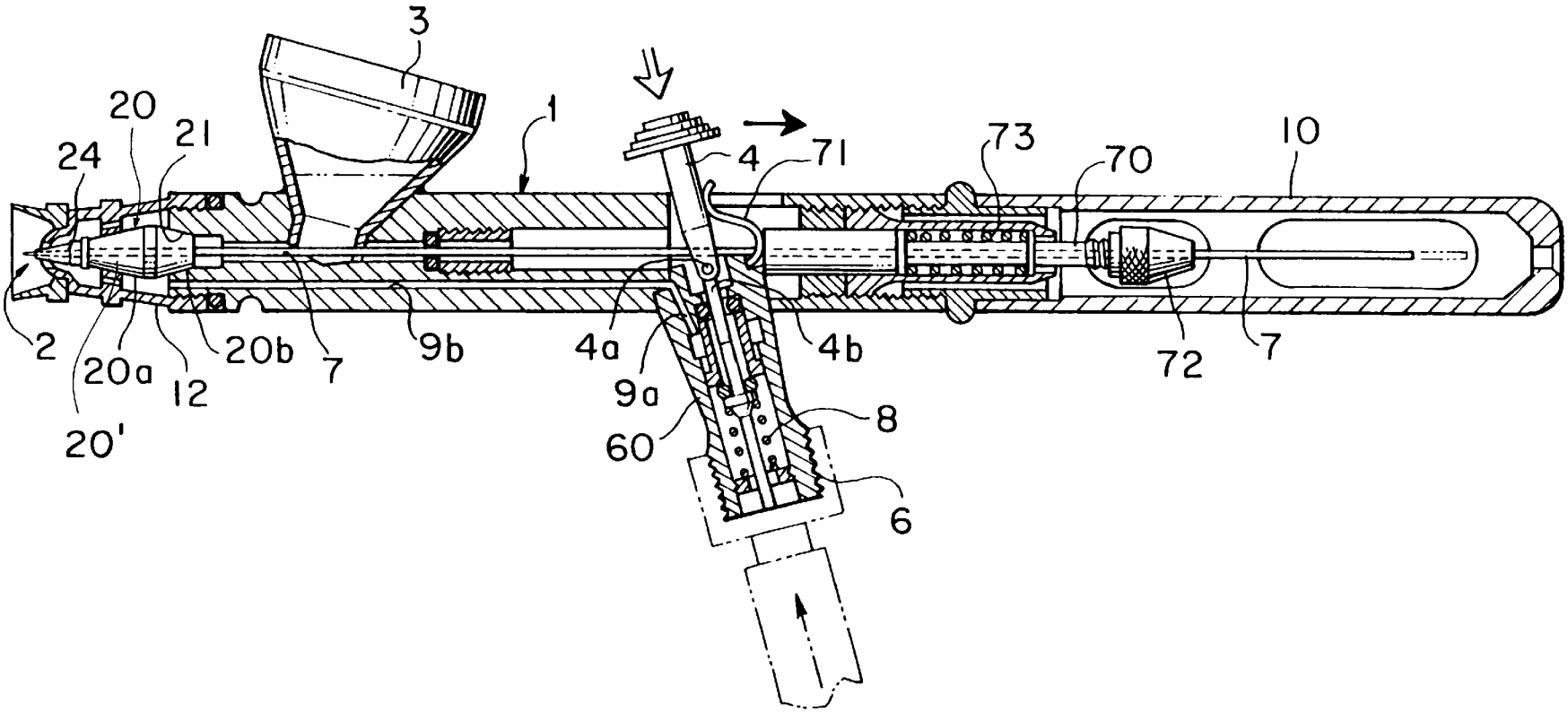
FIG. 1 is a longitudinal section for showing an air brush to which the present invention is embodied.

Referring now to the drawings, one preferred embodiment of the present invention will be described.

The air brush shown in FIGS. 1 to 4 is provided with a main body 1 of an air brush which is formed to be approximately longitudinal shape. The extremity end of the tapered main body 1 of the air brush is provided with a nozzle 2 and a paint container 3 is arranged after the nozzle 2. In addition, an intermediate part of the main body 1 of the air brush is provided with an air supplying port 6 becoming a supplying part for the compressed air and an operating lever 4, and a rear part cap 10 is threadably fitted to and removably installed at the rear end part of the main body 1 of the air brush.

The aforesaid air brush is constructed such that the needle 7 is inserted along the axial core of the main body 1 of the air brush in such a way that it may be advanced or retracted, the needle 7 is retracted under an operation of the aforesaid operating lever 4, thereby liquid paint supplied from a paint container 3 arranged at the front part of the main body 1 of the air brush is blown out of the nozzle 2 together with injection of the compressed air.

The air supplying port 6 arranged at the intermediate part of the main body 1 of the aforesaid air brush is a connecting port acting as either a compressed air supplying hose (c) or an air bomb, a connecting cylinder 60 is integrally connected to the intermediate part of the main body 1 of the air brush and then an air valve 8 is internally installed within the aforesaid connecting cylinder 60. The aforesaid air valve 8 is constructed such that the valve is opened by pushing the operating lever 4 at the upper part of the main body 1 of the air brush.

The operating lever 4 is constructed such that a pushing lever **4*b* is connected to its extremity end through a pivot shaft 4*a* and the aforesaid pushing lever 4*b* is fitted to and inserted into the axial core part of the connecting cylinder 60 connected to the main body 1 of the air brush, thereby it may be supported in such a way that it may be pushed down. In addition, the extremity end of the aforesaid pushing lever 4*b* is abutted against the air valve 8 so as to open the air valve 8 under the pushing-down operation of the operating lever 4**.

That is, as the air valve 8 is opened under the pushing operation of the operating lever 4, the compressed air is flowed from the connecting cylinder 60 acting as the air supplying port into the main body 1 of the air brush, the air is passed through aeration passages **9*a*, 9*b* arranged within the main body 1 and blown out of the nozzle 2**.

In addition, the aforesaid operating lever 4 is supported in such a way that it may be bent from the aforesaid pivot shaft **4*a*, the lever is pulled in a rearward direction and slanted to cause a needle chuck 70 and the needle 7** to be slid in a rearward direction.

The needle 7 inserted into the axial core part of the main body 1 of the air brush is inserted into and held at the needle chuck 70 fitted along the axial core at the rear part of the main body 1 of the air brush.

The needle chuck 70 holds the aforesaid needle 7 and supports it in such a direction as one in which it may be advanced or retracted in an axial direction and this is constructed as a substantial pipe configuration. The needle chuck 70 is fitted to and inserted into the main body 1 of the air brush in such a way that it may be advanced or retracted in respect to the axial core part of it, and the rear end part is supported under a state in which is slightly projected out of the rear end of the main body 1 of the air brush.

An adjusting screw 72 is threadably fitted to the rear end of the needle chuck 70 projected out of the rear end of the main body 1 of the air brush, the adjusting screw 72 is fastened to cause a diameter of the chuck section at the rear end of the needle chuck 70 to be reduced and then the needle 7 inserted into the hole of the needle chuck 70 is fastened and held.

The aforesaid needle chuck 70 is always biased toward a forward direction with a repelling force of a coil spring 73 resiliently installed at an intermediate section in the main body 1 of the air brush. In addition, a substantial S-shape curved operating plate 71 is placed between the front end of the needle chuck 70 and the operating lever 4.

Thus, when the operating lever 4 is pulled in a rearward direction against a repelling force of the aforesaid coil spring 73 and slanted, the chuck 70 and the needle 7 are slid in a rearward direction through the aforesaid operating plate 71, the nozzle 2 at the front end of the main body 1 of the air brush is opened so as to cause pain dripped from the paint container 3 to be blown.

That is, the aforesaid air brush is constructed such that as the operating lever 4 is pushed down, injection of the compressed air from the nozzle 2 is started and further the operating lever 4 is pulled toward the rearward direction to be slanted, thereby the paint is blown out.

The nozzle 2 at the extremity end of the main body 1 of the air brush is comprised of the nozzle member 20 held between the the main body 1 of the air brush and the nozzle cap 12 threadably engaged with and connected to the extremity end and the extremity end of the needle 7 inserted at the core part of the aforesaid nozzle member 20.

Figure 2:
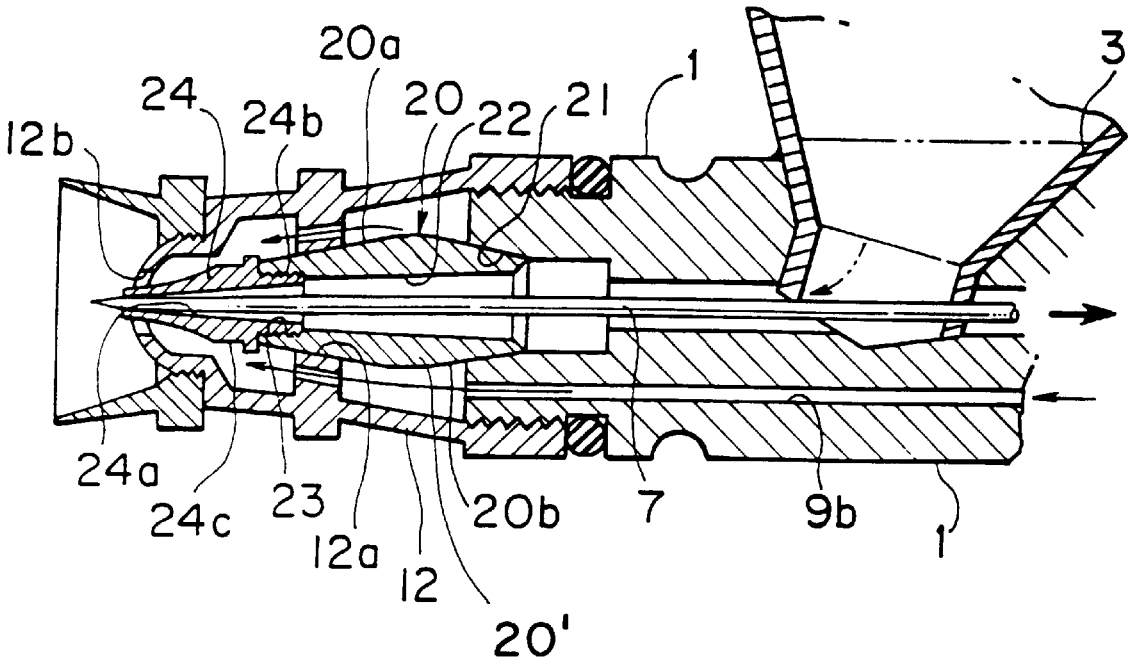
FIG. 2 is an enlarged longitudinal section for showing a nozzle section of the air brush.
Figure 3:
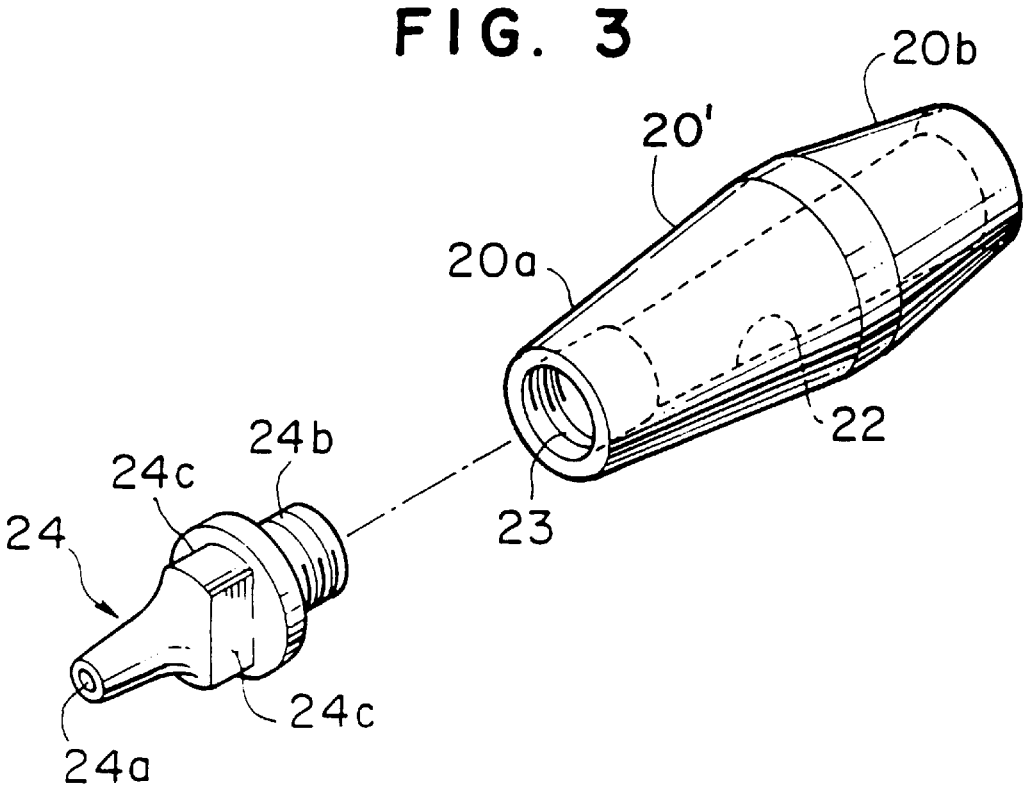
FIG. 3 is an exploded perspective view for showing a nozzle member.

The nozzle member 20 includes a main body 20' of the nozzle member and an extremity end member 24 of the nozzle member is provided on the extremity end (tip) thereof. The aforesaid nozzle member 20 is a substantial bullet-shaped member in which a front part 20*a* formed into a substantial fine conical shape and a rear part 20*b* formed into a substantial fine conical shape are combined to each other and this nozzle member is made of relatively less-expensive brass or nickel silver or the like which is hardly rusted or corroded and well machined (FIGS. 2 and 3). In addition, an insertion hole 22 through which the needle 7 is passed is punched at the axial core of the aforesaid nozzle member 20 as a tapered hole and this is made such that a part near the extremity end of the needle 7 is passed through it with a proper clearance.

The front part 20*a* and the rear part 20*b* of the aforesaid main body 20' of the nozzle member are formed into a substantial fine conical shape and they may not be limited to a complete fine conical shape. Thus, the nozzle member applied in the present invention may be constructed such that the extremity end such as that of the main body 20' of the nozzle member of the preferred embodiment is recessed to cause at least one of the front part or the rear part to be formed into an approximate fine frustum of circular cone. Further, an extremity end angle formed by the fine conical shapes of the front part 20*a* and the rear part 20*b* of the aforesaid main body 20' of the nozzle member may be optionally changed.

In addition, any type of material quality constituting the aforesaid main body 20' of the nozzle member may be applied if it does not generate any rust or corrosion and it shows a superior strength and workability and it is not limited to brass or nickel silver.

The extremity end port of the aforesaid main body 20' of the nozzle member is formed with a threading hole 23 having the extremity end member 24 of the nozzle member which is formed into a recessed hole.

The extremity end member 24 of the nozzle member is a reinforcing member constituting the extremity end port edge of the main body 20' of the nozzle member and this is constituted by SPM (sun platinum metal) or the like such as raw material harder than and having a higher strength than that of the raw material constituting the aforesaid main body 20' of the nozzle member. The extremity member 24 of the nozzle member is quite the same as the screw type nozzle member, a threaded part 24*b* threadably engaged with the threaded hole 23 at the extremity end of the aforesaid main body 20' of the nozzle member is threadably formed at an outer circumference of the base end part and at the same time a holding surface 24*c* holding it against an outer circumferential surface just before the aforesaid threaded part 24*b* with a wrench is formed in parallel with it in an opposing positional relation.

Although the present preferred embodiment of the present invention is applied with SPM (sun platinum metal) as the extremity end member 24 of the aforesaid nozzle member, any type of raw material can be used as the extremity end member of the nozzle member of the present invention if it has a harder material quality than that of the raw material of the other portions of the nozzle member and this is not limited to the aforesaid SPM.

Further, in the preferred embodiment of the present invention, although the prior art screw type nozzle member is applied as the extremity end member of the nozzle member of the nozzle member 20, the nozzle member is not limited to the screw type nozzle extremity end member if the harder member than that of the raw material other than the nozzle extremity end of the nozzle member is applied in accordance with the gist of the present invention and any type of form of it can be set if the nozzle member is closely fitted to and contacted to the extremity end of the needle to act as the extremity end of the nozzle member.

In the preferred embodiment of the present invention, the threaded connecting structure capable of attaining the most superior result has been employed as means to cause the extremity end member 24 of the nozzle member to be engaged with the extremity end of the nozzle member. However, the engaging structure of the extremity end member of the main body 20' of the nozzle member is not limited to the aforesaid threaded engaging structure, but it may be engaged with the extremity end with a press fitting or a welding or the like.

Further, the discharging hole 24*a* through which the needle 7 is passed is punched in a tapered form at the axial core part of the extremity end member 24 of the aforesaid nozzle member and further the extremity end of the needle 7 is fitted under a state in which the extremity end of the needle 7 is closely in the aforesaid discharging hole 24*a*. That is, under a state in which the needle 7 is lightly pushed into the insertion hole 22 of the nozzle member 20, the extremity end member 24 of the aforesaid nozzle is constructed such that the extremity end of the needle 7 is closely contacted with the inner circumferential surface of the discharging hole 24*a* of the extremity end member 24 of the aforesaid nozzle member without any clearance and the nozzle 2 acting as a valve for paint is closed.

The outer circumferential surface of the extremity end of the extremity end member 24 of the aforesaid nozzle member is formed into a fine shape under application of a concave curved line in such a way that the paint smoothly flows along the outer circumferential surface of the extremity end member 24 of the nozzle member through which the paint is discharged in order to cause the compressed air to be smoothly flowed while the air is being passed along the outer circumference of the nozzle member 20.

The nozzle member 20 constructed as described above is constructed such that the rear part 20*b* is fitted into the tapered hole 21 formed in a concave shape around the axial core part of the extremity end surface of the main body 1 of the air brush. The aforesaid tapered hole 21 is a concave hole constituted by applying a taper coincided with the taper of the rear part 20*b* of the nozzle member 20. Thus, when the rear part 20*b* of the aforesaid nozzle member 20 is fitted, the nozzle member 20 is installed necessarily at the extremity end part of the main body 1 of the air brush in a coaxial manner due to a relation between the coinciding tapered shaft and the tapered hole.

In addition, the nozzle cap 12 is threadably connected to the extremity end of the main body 1 of the air brush and then the nozzle member 20 is held between it and the main body 1 of the aforesaid airbrush. The nozzle cap 12 is a cap member of substantial frustum of circular cone installed in a form to be fitted to the extremity end of the main body 1 of the air brush having the nozzle member 20 installed as described above, wherein the base end port to be opened is threadably engaged with the extremity end of the main body 1 of the air brush and connected to it. Additionally, a receiving surface 12*a* to be closely contacted and fitted to the outer circumferential surface of the front part 20*a* of the nozzle member 20 is placed around the inner circumferential part of the nozzle cap 12, and the front part 20*a* of the nozzle member 20 is internally fitted and closely contacted with the aforesaid receiving surface 12*a* under a state in which the nozzle cap 12 is threadably fitted and connected to the extremity end part of the main body 1 of the air brush.

That is, under the installed condition, the aforesaid nozzle member 20 is constructed such that the front part 20*a* and the rear part 20*b* of the main body 20' of the nozzle member are held at its front and rear portions by the tapered hole 21 of the extremity end of the main body 1 of the air brush and the receiving surface 12*a* of the nozzle cap 12. As a result, the nozzle member 20 under its installed stater does not produce any displacement or looseness or the like, so that it is accurately aligned with the axial core of the main body 1 of the air brush and the needle 7 is accurately inserted into the axial core.

In addition, under a state in which the nozzle cap 12 is installed at the extremity end of the main body 1 of the air brush, the extremity end of the aforesaid nozzle member 20, i.e. the extremity end of the extremity end member 24 of the nozzle member is inserted into the central part of the blowing-out hole 12*b* at the extremity end side of the nozzle cap 12, and further held between it and the blowing-out hole 12*b* through a ring-like clearance acting as a blowing-out port for the compressed air (FIG. 2).

In the case that an amount of blowing-out paint is adjusted at the air brush constructed as described above, it is carried out by adjusting the stopped position of the needle 7 under a state in which the operating lever 4 is being spaced apart in a forward or a rearward direction.

In many cases, the extremity end of the needle 7 under a state in which the operating lever 4 is being spaced apart is closely contacted with the extremity end member 24 of the aforesaid nozzle member 20 by an appropriate pressure so as to be adjusted to close the nozzle 2. This adjustment operation is performed such that after the adjustment screw 72 of the needle chuck 70 is loosened, the rear end of the needle 7 is held by hand to push it toward the nozzle 2, the extremity end of the needle 7 is lightly pushed into the extremity end member 24 of the nozzle member 20, the aforesaid adjustment screw 72 is fastened as it is and then the needle 7 is held by the needle chuck 70.

In the air brush, the aforesaid adjustment operation causes the nozzle 2 to be closed under a state in which the operating lever 4 is being spaced apart so as to prevent the paint from being discharged. In addition, the operating lever 4 is slanted in a rearward direction to cause the aforesaid needle 7 to be retracted and then optional amount of paint is blown out.

A user who is familiar with a handling of the air brush understands an important characteristic to perform the operation in a quite light manner in such a way that an excessive load is not applied to the extremity end of the nozzle member 20 when the needle 7 is pushed in a direction toward the nozzle 2 as described above. However, in the case that a person who is not familiar with the air brush performs the aforesaid operation, there may be present a possibility that the needle 7 is forcedly pushed toward the direction of the nozzle 2 and set into it.

When the needle 7 is forcedly pushed into the nozzle in this way, the discharging hole 24*a* of the extremity end member 24 of the nozzle acting as the contact section is pushed wide by the extremity end of the needle 7 to apply an excessive load to it. However, as described above, since the extremity end member 24 of the nozzle member 20 is made of quite hard material quality having a high strength such as SPM, even in the case that an excessive load is applied by the pushing of the needle 7, this may be sufficiently durable against this load and it is possible to avoid disadvantages that the discharging hole 24*a* of the extremity end member 24 constituting the extremity end port edge of the nozzle member 20 is cracked or produces a crack.

Figure 4:
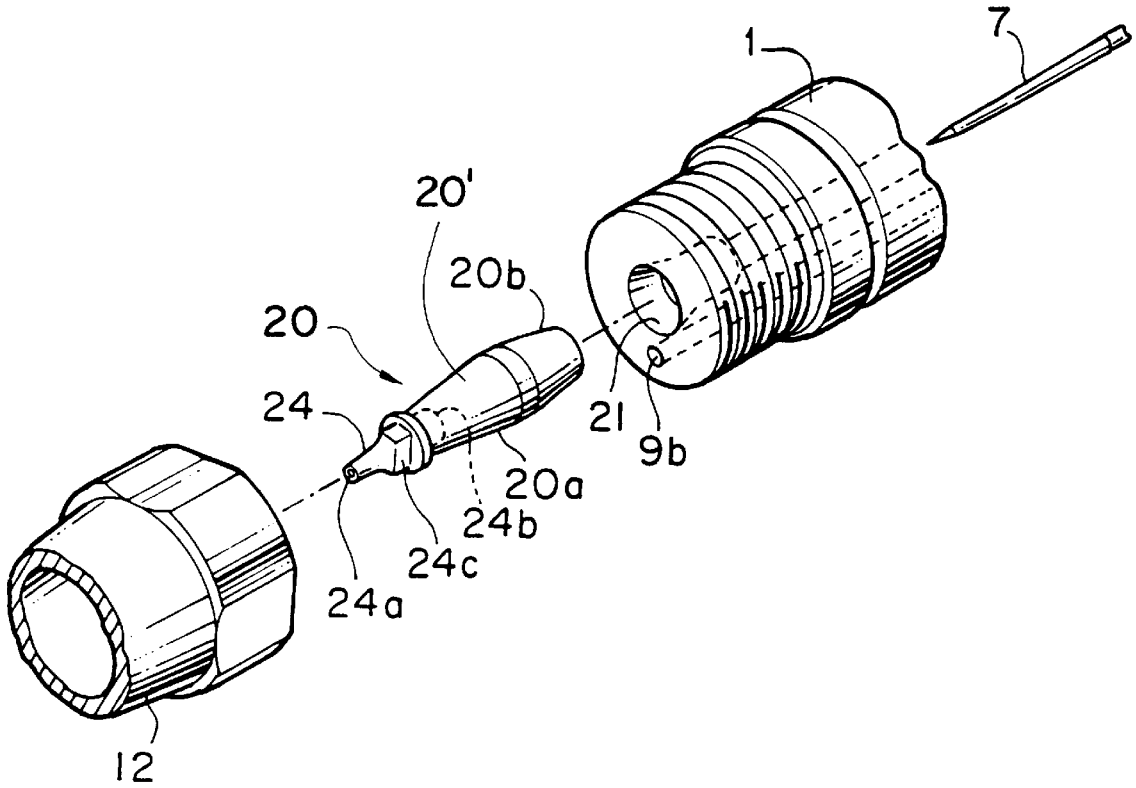
FIG. 4 is an exploded perspective view for showing a nozzle part of the air brush.
Figure 5:
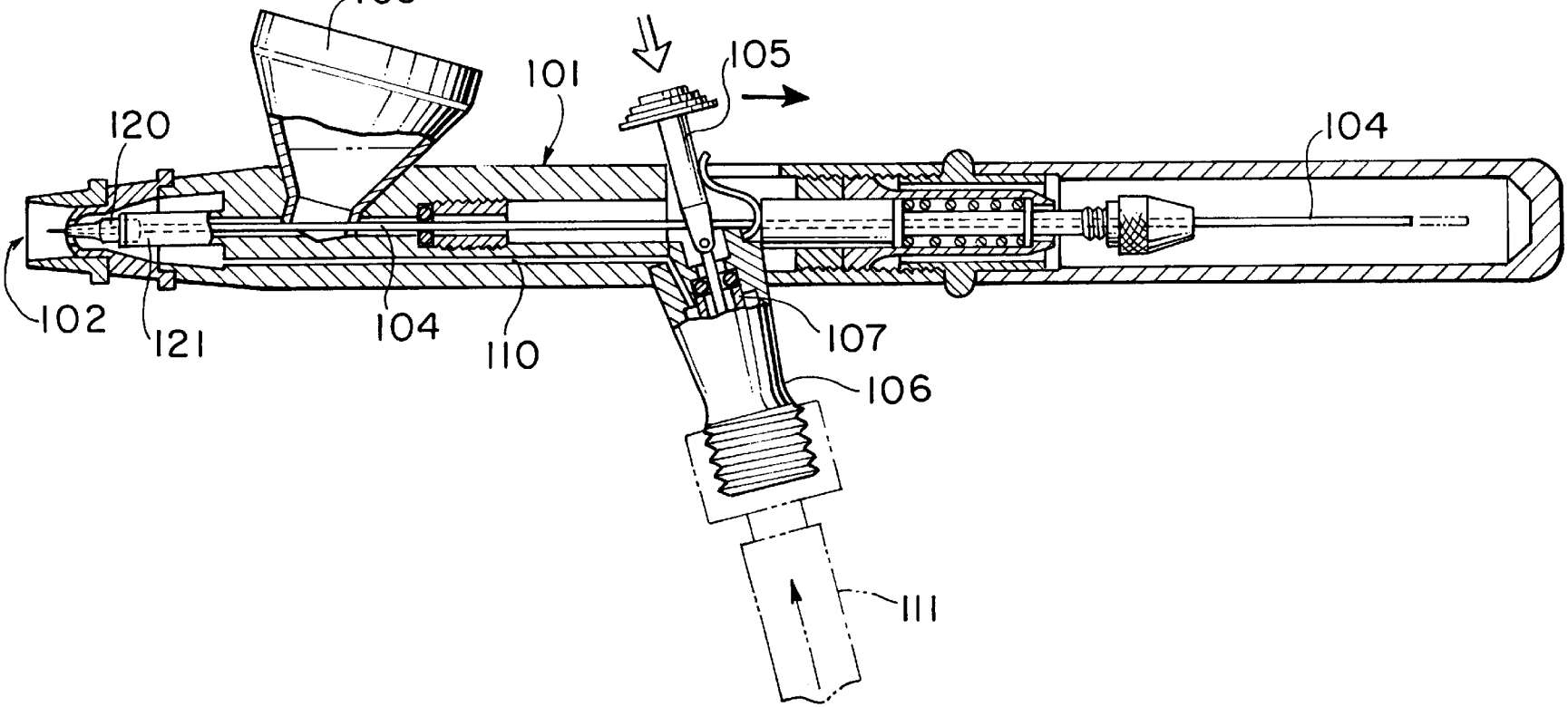
FIG. 5 PRIOR ART
FIG. 5 is a longitudinal section for showing the prior art air brush provided with a screw type nozzle member.
Figure 6:
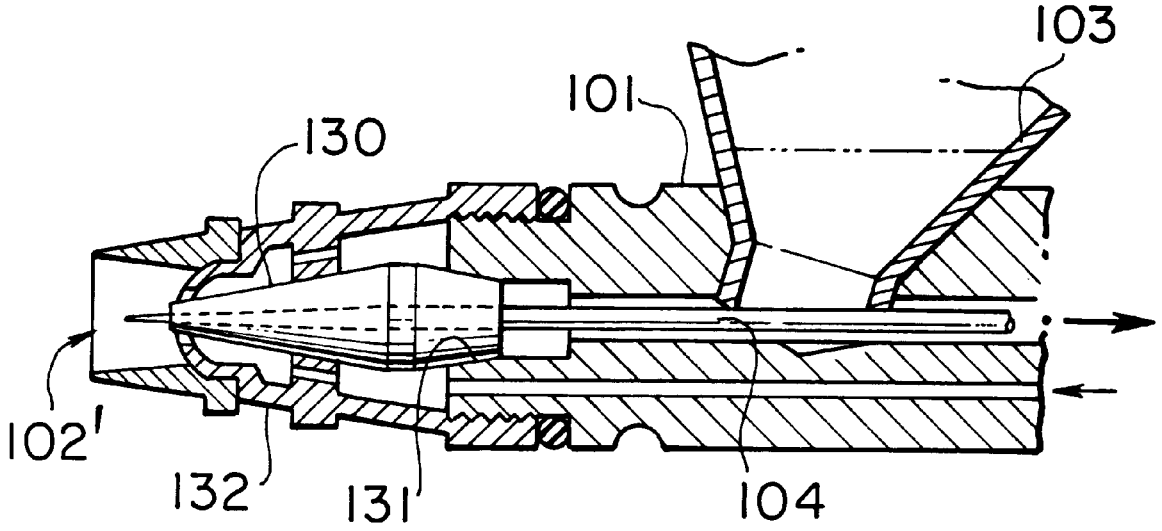
FIG. 6 PRIOR ART
FIG. 6 is a longitudinal section for showing a nozzle part of the prior art air brush provided with a tapered type nozzle member.
Figure 7:
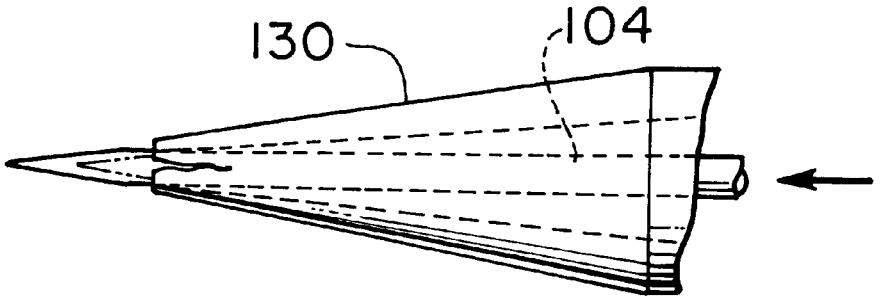
FIG. 7 PRIOR ART
FIG. 7 is an enlarged view for showing a port edge of the extremity end of the tapered type nozzle member.

In addition, in the case that the nozzle 2 is cleaned or repaired for a maintenance work, the needle chuck 72 is loosened to retract the needle, thereafter the nozzle cap 12 at the extremity end of the main body 1 of the air brush is removed and the exposed nozzle member 20 is removed from the extremity end of the main body 1 of the air brush (FIG. 4). Since the nozzle member 20 has a proper large size, this operation shows an easy handling and this can be performed easily without using any tool at all.

In the case that the extremity end member 24 of the nozzle member is removed from the main body 20' of the nozzle member of the aforesaid nozzle member 20, the holding surface 24*c* of the extremity end member 24 of the nozzle member is held by a small-sized wrench to remove the threaded engaged state. In the aforesaid preferred embodiment, since the prior art screw type nozzle member is used as the extremity end member 24 of the nozzle member as it is, even in the case that a new extremity end member of the nozzle member is required due to clogging of paint or its lost state, it is possible to use the prior art screw type nozzle as the extremity end member 24 of the nozzle member so as to re-generate the nozzle member 20.

As already described above, the present invention has been constructed such that the nozzle member held between the extremity end part of the main body of the air brush and the nozzle cap is held in the same manner as that of the prior art tapered type nozzle member and the extremity end of the nozzle member is made of relative more hard extremity end member of the nozzle than that of other portions, so that it is possible to keep a high level of strength of the extremity end port edge of the nozzle and machining accuracy while keeping a superior installing characteristic in the same manner as that of the prior art tapered type nozzle member. Thus, even if a user performs an excessive application such as an excessive pushing of the needle, it is possible to avoid the cracks or cut at the port edge of the extremity end of the nozzle member and then it is possible to improve an accuracy in shape of the nozzle member and to attain a more superior blowing state.

Additionally, the extremity end member of the aforesaid nozzle is made of expensive hard raw material which is hard to be machined, although the hard raw material is used at the extremity end of the nozzle member in a requisite minimum amount and remaining portions can be made of less-expensive raw material which can be easily machined, resulting in that it is possible to avoid an increased cost-up in a raw price of the raw material and its machining cost as well.

In another aspect of the present invention, the air brush is further constructed such that the extremity end member of the aforesaid nozzle member is removably and threadably engaged with the extremity end of the main body 20' of the nozzle member, so that the extremity end member of the nozzle member can be installed at the extremity end of the main body 20' of the nozzle member easily and accurately and at the same time the prior art screw type nozzle member can be used as the extremity end member of the nozzle member as it is, resulting in that it is possible to provide the nozzle member used in the air brush of the present invention at a lower cost.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. An air brush comprising:

a main body having an outlet end, an axial core section and a tapered bore at the outlet end;

a needle including a needle point passing through the axial core of the main body;

a nozzle cap having an inner circumferential part, the nozzle cap removably connected to the outlet end of the main body;

a nozzle member including an outlet portion, a nozzle main body and an extremity end member, the extremity end member is configured to be secured on the outlet portion of the nozzle member, the nozzle member is configured such that the needle point of the needle is positioned along its axial length while the needle is retractably secured within the nozzle cap and the outlet end of the main body, the nozzle member having front and rear parts each with circumferential surfaces, the nozzle member is configured such that the circumferential surfaces of the front part and the rear part are substantially conical in shape, the nozzle main body is made of a general metal material while the extremity end member is made of SPM material;

a needle insertion bore is arranged along the length of the axial core section of the main body and in communication with the tapered bore of the main body;

the rear part of the nozzle member is positioned in the tapered bore of the main body formed around the axial core section of the main body at the outlet end of the main body; and the front part of the nozzle member is secured into the inner circumferential part of the nozzle cap.

2. The air brush as recited in claim 1, wherein the extremity end member is detachably and threadably engaged with the outlet portion of the main body of the nozzle member.

3. The air brush as recited in claim 2, wherein the extremity end member further includes at least two substantially parallel holding surfaces configured to receive an attachment or removal tool and the needle extends between the holding surfaces.

* * * * *